United States Patent [19]

Schlaeger

[11] Patent Number: 4,944,232

[45] Date of Patent: Jul. 31, 1990

[54] DUAL-PURPOSE DEPRESSED CENTER RAILWAY FLAT CAR

[75] Inventor: Gary D. Schlaeger, Springtown, Tex.

[73] Assignee: Burlington Northern Railroad, a wholly owned subsidiary of Burlington Northern, Inc., Fort Worth, Tex.

[21] Appl. No.: 343,036

[22] Filed: Apr. 25, 1989

[51] Int. Cl.[5] ..... B61F 1/00; B60P 3/42

[52] U.S. Cl. ..... 105/355; 410/45; 410/49; 410/54

[58] Field of Search ..... 105/404, 355, 409, 359; 410/54, 47, 49, 52, 58, 68, 94, 42, 45

[56] References Cited

U.S. PATENT DOCUMENTS

| | | | |
|---|---|---|---|
| RE.30,388 | 9/1980 | Mundinger et al. | 410/139 |
| 1,247,822 | 11/1917 | Gregg | 104/404 |
| 2,954,197 | 9/1960 | Laird | 410/49 |
| 3,052,440 | 9/1962 | Bauer et al. | 410/49 |
| 3,180,281 | 4/1965 | Sherrie et al. | 410/94 |
| 3,357,371 | 12/1967 | Gutridge | 410/54 |
| 3,479,968 | 11/1969 | Crompton | 105/238 |
| 3,885,506 | 5/1975 | Mundinger et al. | 105/367 |
| 4,478,155 | 10/1984 | Cena et al. | 105/355 |
| 4,497,259 | 2/1985 | Titterton | 105/359 |
| 4,515,506 | 5/1985 | Van Gompel et al. | 410/94 |
| 4,543,887 | 10/1985 | Baker | 105/355 |
| 4,624,188 | 11/1986 | Kaleta | 105/355 |
| 4,681,041 | 7/1987 | Harris et al. | 105/355 |
| 4,704,062 | 11/1987 | Hale | 414/494 |
| 4,805,539 | 2/1989 | Ferris et al. | 105/404 |

FOREIGN PATENT DOCUMENTS

| | | | |
|---|---|---|---|
| 0501963 | 5/1954 | Canada | 410/52 |
| 0633884 | 1/1962 | Canada | 105/404 |
| 0081246 | 4/1986 | Japan | 410/29.1 |
| 8100147 | 8/1982 | Netherlands | 410/47 |

OTHER PUBLICATIONS

Bethlehem Steel Corporation Press Release dated Nov. 18, 1988.

Railway Age Article of Jul., 1988 (pp. 45–48), "When Boxcars Fill the Bill", David McKenzie.

Journal of Commerce Article of Sep. 26, 1988, "New Railcar Equipment Promise Greater Efficiency".

*Primary Examiner*—Andres Kashnikow

*Assistant Examiner*—Mark T. Le

*Attorney, Agent, or Firm*—Merchant, Gould, Smith, Edell, Welter & Schmidt

[57] ABSTRACT

A railway flatcar (10) is provided for hauling a variety of lading. The car (10) includes a frame (11) having a first section (12), middle section (14) and second section (13). The car (10) has a lower middle section (14) and wrap around bulkheads (22) and (24). The bulkheads (22) and (24) and the floor members (18), (19) and (20) are constructed of an open mesh configuration so as to prevent debris build-up and for reduced wind resistance. The car is adapted to carry a variety of lading including containers and forest products.

14 Claims, 3 Drawing Sheets

DUAL-PURPOSE DEPRESSED CENTER RAILWAY FLAT CAR

FIELD OF THE INVENTION

This invention relates generally to the transportation industry and the area of railway flat cars and more particularly to a depressed center railway flat car which can be used for hauling a variety of cargo, including lumber products and intermodal containers.

DESCRIPTION OF THE PRIOR ART

Generally, depressed center flat cars have traditionally been for single purpose/single use cars, e.g., transformer cars, ingot cars, etc. Payload-to-tare weight relationship is important to maximize the lading weight for the particular car type having a particular tare weight within the upward limit of the maximum weight acceptable on railroads. The most widely accepted gross weight allowance in the United States is 263,000 pounds. However, there are railways and segments of railways which have more or less weight limits. Generally, it follows that if the tare weight of the vehicle can be minimized, the payload capacity can be increased directly by the amount the tare weight can be reduced for a given gross weight allowance on a rail. Since revenues are derived from the amount and value of lading carried as measured by volume and/or weight, it is intrinsically desirable to design a car that can carry the most volume or weight allowable for the particular car design, and prospective lading, within the gross weight allowable on rail.

It is also desirable to design transportation equipment, more specifically railway cars, that will enable the vehicles to remain loaded as much of the time as possible and thereby minimize the cost of the empty return expenses in terms of miles hauled or unproductive days consumed when not loaded with revenue-generating lading. This is usually accomplished in one of two ways: (1) by establishing a general purpose car that can haul a multitude and variety of types (e.g. boxcar which is a suboptimal compromise) of lading in all directions or; (2) to design a "special purpose" car which can handle a limited number of two or more special (e.g. flat car) types of lading in two or more directions.

A desirable and often critically important design feature of transportation equipment is the cost, speed, and safety by which the lading to be shipped can be loaded into or onto the cars with conventional loading or lifting devices. These characteristics often determine the desirability or limitation of transportation equipment in relation to the form of lading characteristics to be shipped. This desirability is frequently determined by the cost of loading and safety of particular combinations of loading methods, machines, men and lading to provide safe, fast, economical methods of loading with conventional equipment is a desired end of the design of transportation equipment.

During transit lading is necessarily exposed to multidirectional forces which tend to shift the lading. To prevent lading shifts resulting in loss or damage, these forces must be contained or absorbed to prevent lading separation from transportation equipment.

In the movement of surface transportation vehicles, wind resistance is an important consideration, especially during empty movement, due to the relationship between wind resistance, fuel cost, and vehicle stability. It is desirable to design a surface vehicle which will present a minimum of wind resistance and remain stable during movement while empty.

In order to safely load, carry, and unload the lading platform of a transportation vehicle it is usually necessary that it be clean, clear, dry, and free of build-up of foreign materials such as snow, ice, water or other debris which would impair the alignment of the lading on the vehicles. There are economical and customer competitive preferences for cars free of debris as it is the shipper's choice when furnished with a vehicle encumbered in any way with debris, to (1) reject the vehicle, (2) load the vehicle on top of debris on the vehicle (which could be unsafe), or (3) incur the expense of removing the debris before loading. In addition, it is possible on some vehicles to have debris, such as snow, ice, dirt or water, build up in transit after loading, which would impair safe movement or unloading at the destination.

Another consideration of designing a railroad car is the advantage in keeping the "center-of-gravity" low, as it tends to reduce the side-to-side lateral sway and the likelihood of a vehicle turning over in transit, or shifting of lading which may result in damage to lading which delays transit enroute to reposition the load for continued safe handling to the destination.

The present invention addresses these considerations and provides for a railway car having a low center-of-gravity and provides for transportation of a variety of lading, including containers, trailers and forest products.

SUMMARY OF THE INVENTION

The invention is a railway flat car for hauling a variety of ladings. The car includes a frame having a first end section, a middle section and a second end section. First and second trucks, having wheels cooperatively connected to the first and second sections and are respectively adapted to be supported by railroad trucks on steel rails or railroad. First, second, and middle floor members are cooperatively connected to the first, second, and middle sections respectively. A first bulkhead is cooperatively connected to one end of the frame and a second bulkhead is cooperatively connected to a second end of the frame. The middle floor member is positioned lower than the first and second members, thereby forming a depressed center, wherein the cars may be used to carry a variety of ladings including polygonal containers and forest products.

In a preferred embodiment, the floor members and bulkheads have an open mesh configuration and the bulkheads are "wrap around" bulkheads.

DETAILED DESCRIPTION OF THE INVENTION

Figure 1:
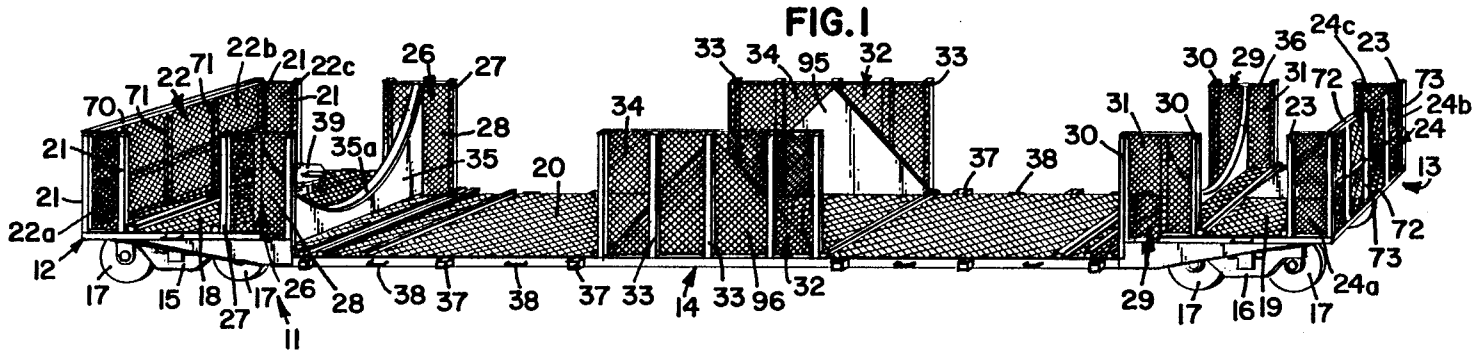
FIG. 1 is a perspective view of a railway car showing one embodiment of the present invention.
Figure 2:
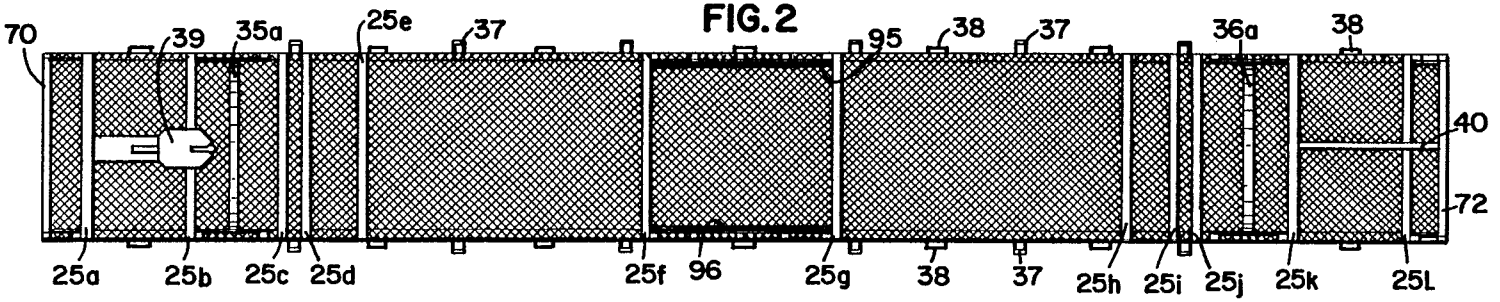
FIG. 2 is a top plan view of the railway car shown in FIG. 2.
Figure 3:
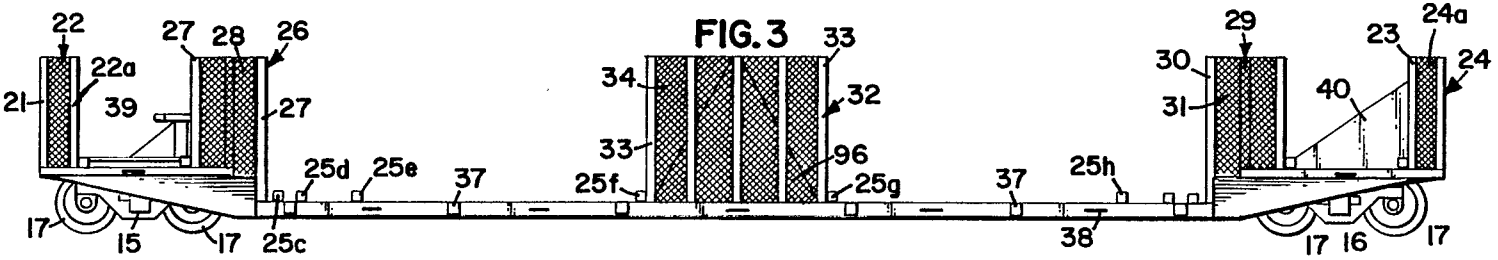
FIG. 3 is a side elevational view of the railway car shown in FIG. 1.

Referring to the figures, wherein like numerals represent like parts throughout the several views, there is generally designated at 10 a railway flat car. The car 10 has a frame 11 which has a first end section 12, second end section 13 and a middle section 14. The frame members are high tensile drawn and welded tubular metal sections. The middle section 14 is lower than the first and second sections 12 and 13, thereby creating a depressed center. The sections 12, 13 and 14 are cooperatively connected by means of vertical steel plates 35 and 36 oriented laterally across the width of the car, having a semi-circular or hyperbolic cut out section. The plates, or cradles, 35 and 36 will be more fully described hereafter.

The first section 12 has a first side sill member **12*a* and a second side sill member 12*b*. The side sill members 12*a* and *b* are drawn, rolled, cast or extruded "C" sections of steel. A face plate 12*d* is welded to the open portion of the C section 12*a*. A similar face plate is welded to the option portion of the section 12*b*, but is not shown in the perspective view of FIG. 14 due to the angle that the perspective view is drawn. However, it is attached and is configured similar to the section 12*d*. A tubular cross member 12*e* is cooperatively connected, by suitable means such as welding, between the first side sill 12*a* and second side sill 12*b*. The tubular cross member 12*e* is of a high tensile tubular steel and has a generally flat surface, with a bottom surface that is in the shape of an elongated V. The V construction allows for extra width at the center of the cross member 12*e* to allow for the connection of a center sill 12*f*. One end of the center sill 12*f* is cooperatively connected to the cross member 12*e* and may be so connected by inserting the center sill 12*f* into an opening in the cross member 12*e* and then welding the center sill 12*f* to the cross member 12*e*. At the other end of the first section 12 is a cradle 35 and the cradle 35 is cooperatively connected to the first side sill 12*a*, second side sill 12*b* and center sill 12*f* by appropriate means such as welding. Two cross member supports 90 and 91 are welded between the side sills 12*a* and 12*b* and to the center sill 12*f*. A first triangular gusset 51 is welded to the outside of the first side sill 12*a* along its top and along another side to the cradle 35. The triangular gusset 51 acts to reinforce the first section 12 of the frame. Similarly, a second triangular gusset 52 is cooperatively connected, by suitable means, such as welding, along its top edge to the second side sill 12*b* and along another edge to the cradle 35. The gussets 51 and 52 extend beyond the first section 12 and have rectangular sections cooperatively connected to side sills 14*a* and 14*b***.

The second section 13 has a first side sill member **13*a* and a second side sill member 13*b*. The side sill members 13*a* and *b* are drawn, rolled, cast or extruded "C" sections of steel. A face plate 13*d* is welded to the open portion of the C section 13*a*. A similar face plate is welded to the option portion of the section 13*b*, but is not shown in the perspective view of FIG. 14 due to the angle that the perspective view is drawn. However, it is attached and is configured similar to the section 13*d*. A tubular cross member 13*e* is cooperatively connected, by suitable means such as welding, between the first side sill 13*a* and second side sill 13*b*. The tubular cross member 13*e* is of a high tensile tubular steel and has a generally flat surface, with a bottom surface that is in the shape of an elongated V. The V construction allows for extra width at the center of the cross member 13*e* to allow for the connection of a center sill 13*f*. One end of the center sill 13*f* is cooperatively connected to the cross member 13*e* and may be so connected by inserting the center sill 13*f* into an opening in the cross member 13*e* and then welding the center sill 13*f* to the cross member 13*e*. At the other end of the first section 13 is a cradle 36 and the cradle 36 is cooperatively connected to the first side sill 13*a*, second side sill 13*b* and center sill 13*f* by appropriate means such as welding. Two cross member supports 92 and 93, similar to supports 90 and 91, are welded between the side sills 13*a* and 13*b* and to the center sill 13*f*. A first triangular gusset 53 is welded to the outside of the first side sill 13*a* along its top and along another side to the cradle 36. The triangular gusset 53 acts to reinforce the second section 13 of the frame. Similarly, a second triangular gusset 54 is cooperatively connected, by suitable means, such as welding, along its top edge to the second side sill 13*b* and along another edge to the cradle 36. The gussets 53 and 54 extend beyond the second section 13 and have rectangular sections cooperatively connected to side sills 14*a* and 14*b***.

The middle section 14 has a first side sill **14*a* cooperatively connected at one end to the first cradle 35 and at its other end to the cradle 36. A second side sill member 14*b* is similarly cooperatively connected between the cradles 35 and 36. The side sills 14*a* and 14*b* may be cooperatively connected by any suitable means, such as welding. The side sills 14*a* and 14*b* are also similar to the side sills 12*a* and 12*b* in that it is a drawn, rolled, cast or extruded C section with a faceplate 14*d* cooperatively connected across the open portion of the C section. The side sills 14*a* and 14*b* are cooperatively connected to the cradles at a position below the first and second sections, so as to form a depressed center section. A plurality of tubular cross members 14*f* are cooperatively connected between the side sills 14*a* and 14*b* by appropriate means such as welding. Tubular elongate members 14*g* are cooperatively connected between the cradle 35 and cross members 14*f*, between cross member 14*f* and cross member 14*f*, and between cross member 14*f* and cradle 36** by appropriate means, such as welding for structural support.

A first truck assembly 15 is cooperatively connected, by means well known in the industry, to the first end section 12. A second truck assembly 16 is similarly cooperatively connected to the second end section 13. Preferably, the trucks are roller bearing stabilized non-hunting trucks, which are presently available in the industry. The truck assemblies 15 and 16 have wheels 17 which are adapted to be supported on railroad tracks.

A first floor member 18 is cooperatively connected to the first end section 12 by means well known in the art, such as welding. The first floor member 18 is approximately a 10 foot by 10 foot platform which is preferably constructed from a metallic grid material. The grid material has an open structure and the holes formed in the grid sections is air permeable and allow for debris to pass through. A second floor member 19 is similarly cooperatively connected to the second end section 13 and is also approximately 10 feet by 10 n feet. The second section is made of an air permeable structural metallic grid material. A middle floor member 20 is cooperatively connected to the middle section 14 and is approximately 10 feet by 53 feet. The middle floor member is similarly constructed of an air permeable structural metallic grid section. The floor members 18, 19 and 20 are welded to the frame 11.

Four side supports 21 are cooperatively connected to the first end section 12, by suitable means, such as welding and a "wrap around" bulkhead 22 is cooperatively connected thereto, by suitable means, such as welding. The wrap around first bulkhead 22 has a side section 22*a*, center section 22*b* and a second side section 22*c*. The wrap around bulkhead 22 is constructed in wind permeable fashion having an open mesh material reducing wind resistance. The open mesh material is constructed of a heavy duty expanded or extended high tensile metal to yield a structure of suitable strength. Horizontal cross braces 70 are welded between the side supports 21 and further horizontal braces 71 are welded between the two cross braces 70 for additional structural support while still maintaining the wind permeability.

Four side supports 23 are cooperatively connected to the second end section 13, by suitable means, such as welding and a wrap around bulkhead 24 is cooperatively connected thereto, by suitable means, such as welding. The wrap around second bulkhead 24 has a side section 24*a*, center section 24*b* and a second side section 24*c*. The wrap around bulkhead 24 is constructed from an open mesh air permeable structural metallic material so as to reduce wind resistance in the same manner and construction as bulkhead 22. Details of construction of the drawbar assembly, braces, air brake assembly and non-hunting trucks and their connectivity to the preferred embodiment (car frame shown) are not shown in detail as they are well-known in the art.

A plurality of rectangular polygonal crossbearing members 25*a*–251 are cooperatively connected to the floor members at appropriate intervals so that a variety of lengths of polygonal shipping containers may rest on them, which range in length from 20 feet to 53 feet, up to nine feet in width and up to nine feet in height and capable of being double-stacked vertically, may be secured to the railway flat car 10, or upon which a variety of bundles or packages of lumber or forest products may be stacked vertically in multiples and suitably secured thereto. The cross bearing members also add to the structural integrity of the car 10. The depressed middle sections allow for the containers to be double stacked and still not exceed height limitations. The bearing members 25*a*–1 are well known in the art as is the means to cooperatively connect them to the frame 11. The distance between bearing members 25*e* and 25*h* is approximately forty feet. The distance between bearing members 25*d* and 25*i* is approximately forty-five feet and the distance between bearing members 25*c* and 25*j* is approximately forty-eight feet. The distance between bearing members 25*a* and 25*b* is approximately six feet and the distance between bearing members 25*k* and 25*l* is also approximately six feet. The bearing members 25*a*–1 are equipped with a suitable locking device (also well known in the art) to secure the shipping containers to the railway flatcar 10. These distances may be varied to take into account various lengths of the goods being transported. The locking devices (not shown) are well known in the art.

The railway flatcar 10 has three sets of side sills. The first set of side sills comprises a pair of side sills 26 which are cooperatively connected proximate the first section 12 to the frame 11. High tensile strength tubular steel posts 27 are cooperatively connected to the frame and an expanded metal grid 28 is cooperatively connected to the post 27 to form the first set of side sills 26.

The second set of side sills comprises a pair of side sills 29 which are cooperatively connected proximate the second section 13 to the frame 11. High tensile strength tubular steel posts 30 are cooperatively connected to the frame and an expanded metal grid 31 is cooperatively connected to the post 30 to form the second set of side sills 29.

The third set of side sills comprises a pair of side sills 32 which are cooperatively connected proximate the middle section 14 to the frame 11. High tensile strength tubular steel posts 33 are cooperatively connected to the frame and an expanded metal grid 34 is cooperatively connected to the post 33 to form the third set of side sills 32. Solid triangular gussets 95 and 96 are cooperatively connected, by means of welding, to the inside of the side sills 32 to provide for structural support.

A first cradle 35 is cooperatively connected to the frame 11 and abuts the first end section 12. The cradle 35 extends downward to engage the lower middle section 14. The cradle 35 is constructed of a suitable material, such as one-inch steel plate 10*a*, and is cooperatively connected to the frame 11 by any suitable means, such as welding. The cradle 35 provides a structural bulkhead and is an integral portion of the car 10. The cradle 35 extends between the side sills 26. The ends of the cradle 35 extend the entire length of the side sills 26, but the center section of the cradle 35 is substantially lower. The top surface of the cradle forms a curved surface which is adapted to carry circular objects, such as long poles or logs. The lowest point of the curved surface 35*a* has a height from the middle section 14 that is just slightly higher than the difference in height between the middle section 14 and the first section 12 so the lading would clear or just touch the cross bearing pieces on the ends of the car.

A second cradle 36 is cooperatively connected to the frame 11 and abuts the second end section 13. The cradle 36 extends downward to engage the lower middle section 14. The cradle 365 is constructed of a suitable material, such as one-inch steel plate 36*a*, and is cooperatively connected to the frame 11 by any suitable means, such as welding. The cradle 36 provides a structural bulkhead and is an integral portion of the car 10. The cradle 36 extends between the side sills 32. The ends of the cradle 36 extend the entire length of the side sills 32, but the center section of the cradle 36 is substantially lower. The top surface of the cradle forms a curved surface which is adapted to carry circular objects, such as logs poles, or pipes. The lowest point of the curved surface 36a has a height from the middle section 14 that is just slightly higher than the difference in height between the middle section 14 and the second section 14.

A plurality of stub stake pockets 37 and strap tie down brackets 38 are attached to the sides of the car 10 and may be utilized to secure the lading to prevent shifting as well as loss and/or damage. A "fold down fifth wheel" pedestal or stancion 39 is cooperatively connected, by means well known in the art, to the railway car 10 so as to allow a standard highway trailer to be moved on the railway car 10. A brace 40 is cooperatively connected to the second end section 13.

The open mesh material is constructed of a heavy duty metal to yield a structure of suitable strength. Horizontal cross braces 72 are welded between the side supports 23 and further horizontal braces 73 are welded between the two cross braces 72 for additional structural support while still maintaining the wind permeability.

Figure 4:
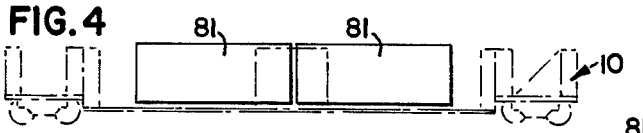
FIG. 4 is a schematic representation of the railway car of FIG. 1 carrying two twenty foot containers.
Figure 5:
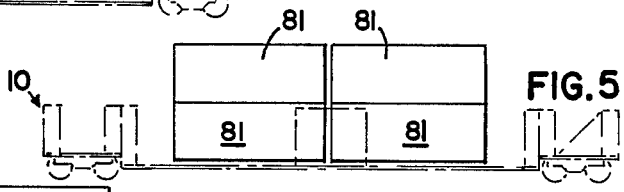
FIG. 5 is a schematic representation of the railway car of FIG. 1 carrying four twenty foot containers.
Figure 6:
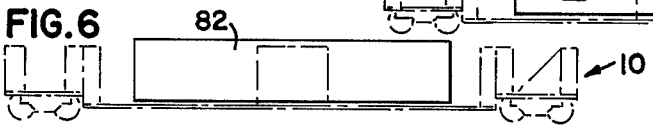
FIG. 6 is a schematic representation of the railway car of FIG. 1 carrying one forty foot container.
Figure 7:
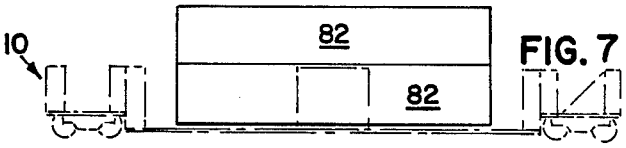
FIG. 7 is a schematic representation of the railway car of FIG. 1 carrying two forty foot containers.

FIGS. 4–14 show the versatility of the railway car 10 while in operation. FIG. 4 is a schematic representation of how two twenty foot containers 81 may be positioned on the car 10. FIG. 5 is a schematic representation showing how four twenty foot trailers 81 may be double stacked and carried by the railway car 10. FIG. 6 shows a schematic representation of the railway car 10 carrying one forty foot container 82, while FIG. 7 shows the railway car 10 carrying two forty foot containers 82.

Figure 8:
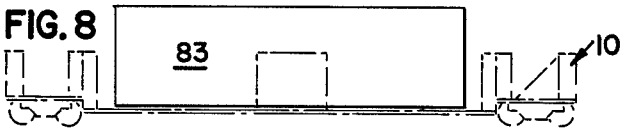
FIG. 8 is a schematic representation of the railway car of FIG. 1 carrying one forty-five foot container.
Figure 9:
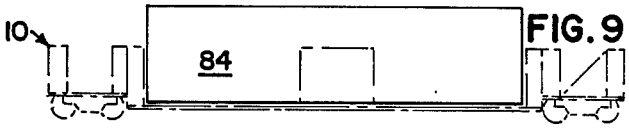
FIG. 9 is a schematic representation of the railway car of FIG. 1 carrying one forty-eight foot container.
Figure 10:
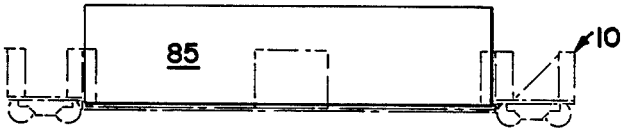
FIG. 10 is a schematic representation of the railway car of FIG. 1 carrying one fifty-two foot container.

FIGS. 8 and 9 show a schematic representation of the railway car 10 hauling a forty-five foot container 83 and forty-eight foot container 84 respectively. FIG. 10 shows how the railway car 10 may carry a fifty-two foot container 85. All of the Figs., FIGS. 4–10 described so far, utilize only the depressed middle section as it may accommodate the trailer configurations discussed so far.

Figure 11:
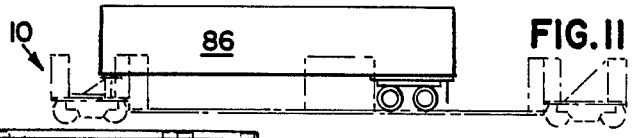
FIG. 11 is a schematic representation of the railway car of FIG. 1 carrying one forty-five foot trailer.

FIG. 11 shows a schematic representation of the railway car 10 carrying a forty-five foot trailer 86 and which utilizes the fifth wheel 39 to secure the trailer.

Figure 12:
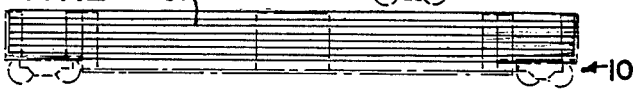
FIG. 12 is a schematic representation of the railway car of FIG. 1 carrying seventy foot poles.
Figure 13:
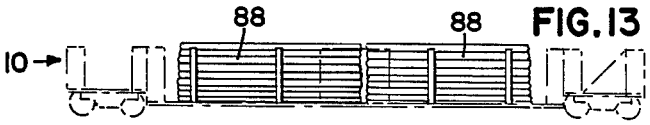
FIG. 13 is a schematic representation of the railway car of FIG. 1 carrying twenty foot logs.
Figure 14:
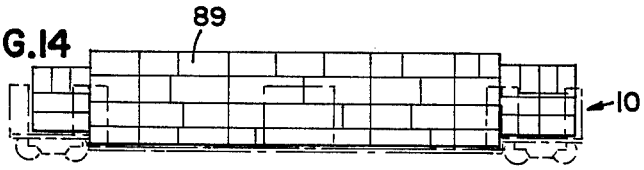
FIG. 14 is a schematic representation of the railway car of FIG. 1 carrying lumber.
Figure 15:
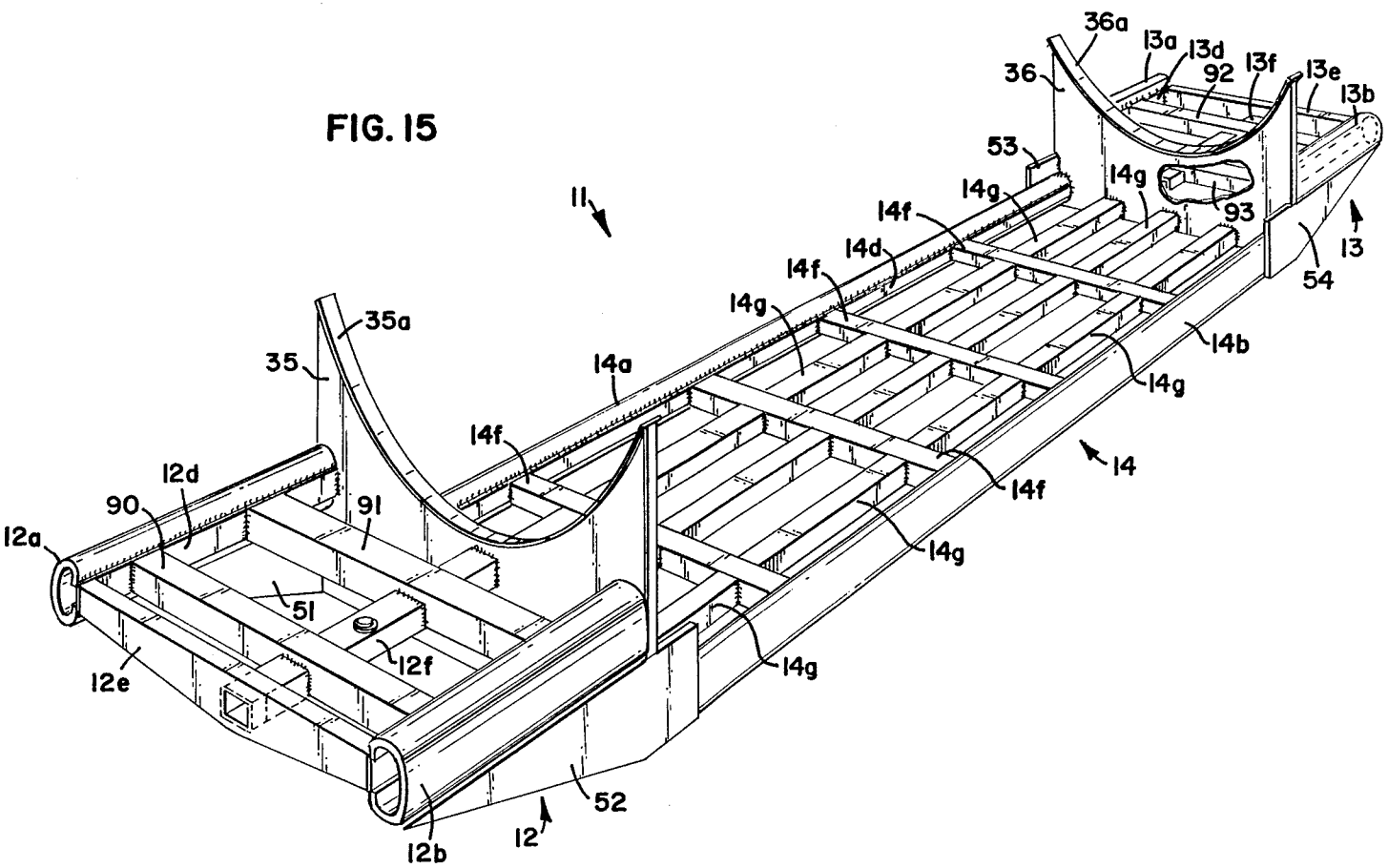
FIG. 15 is a perspective view of the frame of the railway car shown in FIG. 1.

FIGS. 12–14 show the versatility of the car for use in carrying lumber and lumber products. Typically, the car would haul lumber products in one direction and containers or trailers in the reverse direction, thereby allowing the car to be more fully utilized.

FIG. 12 shows a schematic representation of the railway car carrying seventy foot poles 87. The poles would be positioned and carried above the two cradle members 35 and 36.

FIG. 13 shows a schematic representation of the car 10 carrying twenty foot logs 88.

Finally, FIG. 14 is a schematic showing the car 10 carrying lumber of various sizes. The lumber may be carried on both the depressed middle section as well as the raised first and second sections.

The foregoing is illustrative of the various loads which this versatile car 10 may carry. The specifics of how one would tie down and secure the various containers is not discussed further as that would be well-known to a person skilled in the art after reading the foregoing disclosure.

Other modifications of the invention will be apparent to those skilled in the art in light of the foregoing description. This description is intended to provide specific examples of individual embodiments which clearly disclose the present invention. Accordingly, the invention is not limited to these embodiments or the use of elements having specific configurations and shapes as present herein All alternative modifications and variations of the present invention which follow in the spirit and broad scope of the appended claims are included.

I claim:

1. A dual purpose railway flat car for hauling a variety of ladings, said car comprising:

(a) a frame having a first end section, a middle section and a second end section;

(b) first and second trucks, having wheels, cooperatively connected to said first and second sections respectively adapted to be supported on railroad tracks;

(c) first, second and middle floor members cooperatively connected to said first, second and middle sections respectively;

(d) a first bulkhead cooperatively connected to one end of said frame and a second bulkhead cooperatively connected to a second end of said frame;

(e) a first integral structural cradle cooperatively connected to said frame positioned between said first section and said middle section;

(f) a second integral structural cradle cooperatively connected to said frame positioned between said second section and said middle section; and (g) said middle floor member positioned lower than said first and second members, thereby form a depressed center, said cradles configured to carry cylindrical objects and also to form integral intermediate bulkheads for said depressed center, wherein said car may be used to carry a variety of ladings including polygonal containers and forest products.

2. The railway flat car of claim 1, wherein said floor members have an air permeable open mesh configuration, wherein build-up of debris is prevented and also resulting in a lower tare weight.

3. The railway flat car of claim 1, wherein said bulks heads are wrap around bulkheads.

4. The railway flat car of claim 3, wherein said bulkheads have an open mesh design, wherein wind resistance is reduced and also results in a lower tare weight.

5. The railway flat car of claim 1, wherein said middle member is approximately 53 feet in length and said first and second members are approximately 10 feet in length.

6. The railway flat car of claim 1, further comprising a first set of side sill panels cooperatively connected to said frame proximate the center of said middle section.

7. The railway flat car of claim 6, further comprising a second set of side sill panels cooperatively connected to said frame proximate said first and middle members and a third set of side sill panels cooperatively connected to said frame proximate said second and middle members.

8. The railway flat car of claim 7, wherein said cradles having a curved top surface adapted to carry circular objects.

9. The railway flat car of claim 1, further comprising a fold down fifth wheel cooperatively connected to one of said first and second members, wherein a highway trailer may be connected to the car and thereby transported.

10. The railway flat car of claim 1, further comprising a first set of bearing members cooperatively connected to said middle member, said first set of bearing members being approximately 40 feet apart.

11. The railway flat car of claim 1, further comprising a second set of bearing members, cooperatively connected to said middle member, said second set of bearing members being approximately 45 feet apart.

12. The railway flat car of claim 1, further comprising a third set of bearing members cooperatively connected to said middle member, said third set of bearing members being approximately 48 feet apart.

13. The railway flat car of claim 1, further comprising stake pockets and strap anchors cooperatively connected to said frame.

14. The railway flat car of claim 1, further comprising gussets cooperatively connected to said first section and said second section to add to the structural integrity of the car.

* * * * *

UNITED STATES PATENT AND TRADEMARK OFFICE

CERTIFICATE OF CORRECTION

PATENT NO. : 4,944,232

DATED : July 31, 1990

INVENTOR(S) : GARY D. SCHLAEGER

It is certified that error appears in the above-identified patent and that said Letters Patent is hereby corrected as shown below:

On the title page, in item [73], the Assignee should read

--Burlington Northern Railroad Company, a wholly owned subsidiary of Burlington Northern, Inc., Fort Worth, Tex.--

Signed and Sealed this

Second Day of February, 1993

*Attest:*

STEPHEN G. KUNIN

*Attesting Officer*

*Acting Commissioner of Patents and Trademarks*